US005164011A

United States Patent [19]

Ray

[11] Patent Number: 5,164,011

[45] Date of Patent: Nov. 17, 1992

[54] DOOR PAINTING FIXTURE

[76] Inventor: David D. Ray, 915 W. Madison, Springfield, Mo. 65806

[21] Appl. No.: 635,660

[22] Filed: Dec. 28, 1990

[51] Int. Cl.[5] ..... B05C 13/00

[52] U.S. Cl. ..... 118/500; 118/502; 118/503

[58] Field of Search ..... 118/500, 502, 503, 504; 269/54.2, 238.0, 254 R, 124; 248/125, 145, 131; 242/129.51

[56] References Cited

U.S. PATENT DOCUMENTS

| | | | |
|---|---|---|---|
| 684,097 | 10/1901 | Quigley | 118/500 |
| 930,129 | 8/1909 | Beausejour et al. | 118/503 |
| 2,432,137 | 12/1947 | Burke | 269/254 |
| 3,071,253 | 1/1963 | Walsh | 248/125 |
| 4,193,375 | 3/1980 | Sharland | 118/504 |

*Primary Examiner*—Michael G. Wityshyn
*Assistant Examiner*—Brenda Lamb
*Attorney, Agent, or Firm*—Jacobson, Price, Holman & Stern

[57] ABSTRACT

A door painting fixture which will hold a door in generally vertical position with the door being supported for rotational movement about a centrally located vertical axis to enable a door to be completely painted by the use of any of several well known paint applying techniques without the necessity of the painter moving to opposite sides of a door or lifting the door and manually rotating it 180°. The fixture includes opposed, vertically spaced and aligned pins having tapered or pointed facing ends to engage the top and bottom edges of a door at a center point thereof with the pins being supported by a stand having laterally extending arms supporting the pins with the upper arm including a spring arrangement to bias the upper pin towards the lower pin to retain the door in position in the fixture. The lower arm of the stand includes a structure to frictionally retain the door in 180° rotated positions which is in the form of a resilient belt adjustably anchored at its ends and providing an upwardly bowed central portion to frictionally engage the bottom edge of the door to retain the door in one of two 180° related positions. The stand is constructed of so that it can be disassembled or assembled to facilitate its transportation to the site of use.

7 Claims, 1 Drawing Sheet

DOOR PAINTING FIXTURE

BACKGROUND OF INVENTION

1. Field of Invention

The present invention generally relates to a device for holding an entity in optimum position while a work operation is performed on the entity. More specifically, the invention relates to a door painting fixture which will hold a door in generally vertical position with the door being supported for rotational movement about a centrally located vertical axis to enable a door to be completely painted by the use of any of several well known paint applying techniques without the necessity of the painter moving to opposite sides of a door or lifting the door and manually rotating it 180°. The fixture includes opposed, vertically spaced and aligned pins having tapered or pointed facing ends to engage the top and bottom edges of a door at or near a center point thereof with the pins being supported by a stand having laterally extending arms supporting the pins with the upper arm including a spring arrangement to bias the upper pin towards the lower pin to retain the door in position in the fixture. The lower arm of the stand includes a structure to frictionally retain the door in 180° rotated positions which is in the form of a resilient belt adjustably anchored at its ends and providing an upwardly bowed central portion to frictionally engage the bottom edge of the door to retain the door in one of two 180° related positions. The stand is constructed so that it can be quickly disassembled and assembled to facilitate its transportation to the site of use.

2. Description of the Prior Art

Various types of work holders have been provided to support various entities while work operations are being performed. When a painter is faced with the task of painting a plurality of doors in a large building, conventional practice involves the doors being leaned against a vertical wall while one side of the door is painted and then the door is manually lifted and rotated 180° and returned to its leaning position against a vertical wall while the other side of the door is painted. Usually, a paint applying technique is used which includes some type of power assisted paint application such as a conventional paint sprayer.

The prior art in this field of endeavor does not include a fixture which can effectively support a door that will enable the door to be rotatably adjusted about a generally central vertical axis to expose both sides of the door to a painting operation by merely rotating the door 180° as incorporated into this invention and additionally, the prior art does not disclose a structure for frictionally and releaseably securing the door in its 180° rotated positions.

SUMMARY OF THE INVENTION

An object of the present invention is to provide a door painting fixture in the form of a knockdown stand having laterally extending upper and lower arms with each of the arms including a vertically extending pin with the pins being in vertical alignment and in spaced opposed relation for engagement with the center of the top and bottom edges of the door to enable a door to be supported for rotational movement about a central vertical axis.

Another object of the invention is to provide a door painting fixture in accordance with the preceding object in which the pins have tapered pointed ends with the upper arm including a spring biasing structure to enable limited pivotal movement to enable the door to be easily mounted in the fixture with the spring biasing structure securely retaining the door mounted on the pins for rotational movement.

A further object of the invention is to provide a door painting fixture in accordance with the preceding objects in which the lower arm is provided with an extension in alignment with the pin which includes a resilient belt having its ends adjustably anchored to form an upwardly bowed central portion which will frictionally engage the bottom edge of the door in spaced relation to the lower pin to releaseably and frictionally retain the door in its 180° rotated positions to facilitate the door being painted first on one side with a paint applying device and the door than rotated 180° with paint being applied to the other side with the upwardly bowed belt retaining the door in both of its 180° rotated positions.

Still another object of the invention is to provide a door painting fixture as set forth previously in which the stand is constructed of components that can be disassembled and assembled to enable the components to be easily transported to a site of use while in a collapsed and compact condition and then easily set up for use.

A still further object of the invention is to provide a door painting fixture in accordance with the preceding objects which is simple to use, effective to reduce the time and labor necessary to paint doors, relatively inexpensive to manufacture, easily collapsed and set up and effective in supporting doors while they are being painted.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
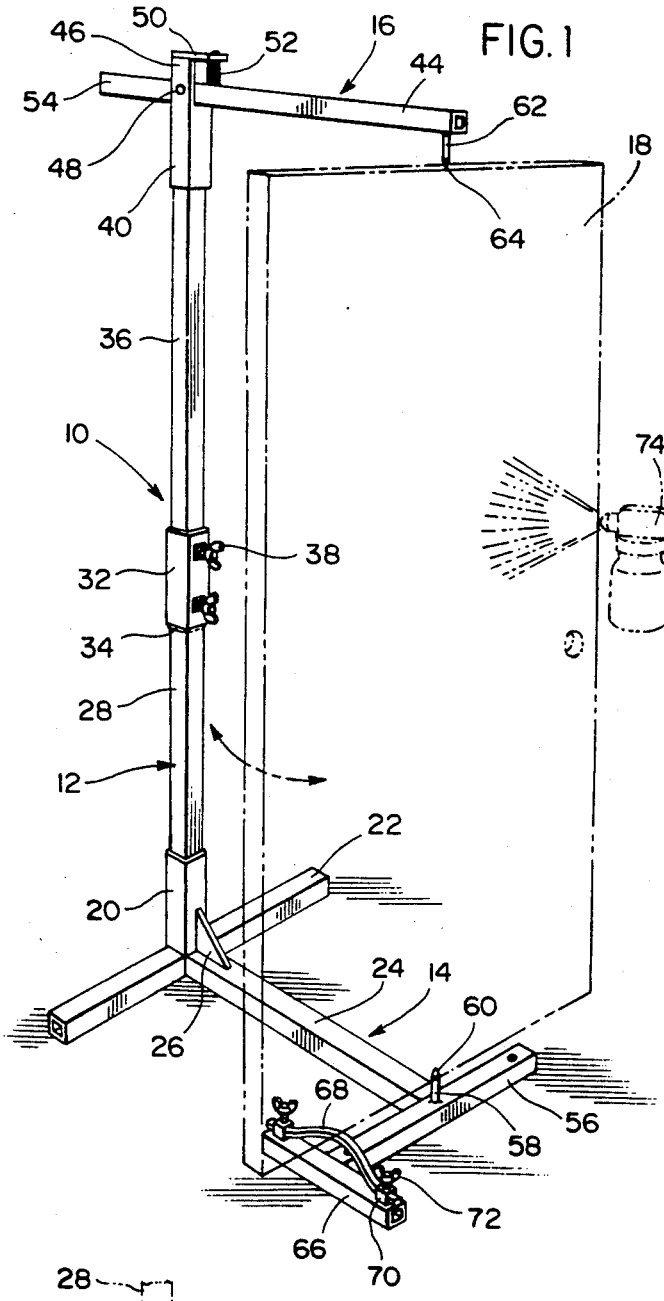
FIG. 1 is a perspective view of the door painting fixture of the door painting fixture of the present invention illustrating a door associated therewith.
Figure 2:
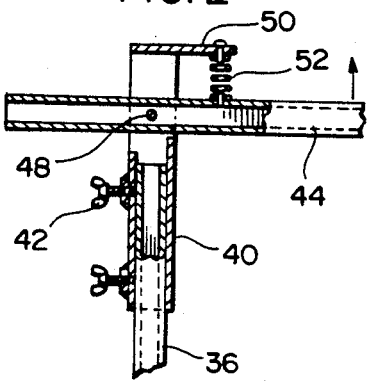
FIG. 2 is a detailed sectional view of the upper arm and spring biased structure urging an upper pin into engagement with the door.
Figure 3:
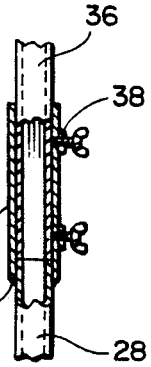
FIG. 3 is a sectional view illustrating further the structural details of the stand.
Figure 4:
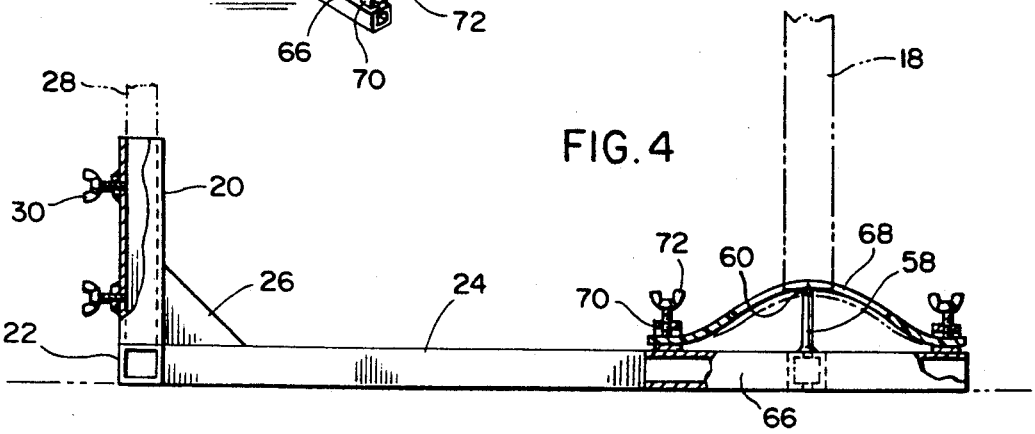
FIG. 4 is a sectional view illustrating the structural details of the bowed rubber belt and the manner in which it is adjustably mounted for engaging the bottom edge of the door.

Referring now specifically to the drawings, the door painting fixture of the present invention is generally designated by reference numeral 10 and includes a stand generally designated by reference numeral 12 which includes a lower arm assembly 14 and an upper arm assembly 16 which engage and support a door 18 from the center of the top and bottom edges thereof.

The stand 12 includes a vertically disposed, relatively short lower tubular member 20 in the form of a square tube which is rigidly connected to a transversely extending base member 22 with the tubular member 20 being perpendicular to and at the center of the base member 22 with the components being suitably welded together. The lower arm assembly 18 includes a tubular arm 24 rigidly attached to an edge of the base member 22 by welding in perpendicular relation thereto and in the same plane as the base member 22 with a reinforcing gusset plate 26 being connected to the perpendicular surfaces of the arm 24 and the tubular member 20. Telescoped into the tubular member 20 is a vertical standard 28 also in the form of a square tubular member with wing-type set screws or bolts 30 threaded into the tubular member 20 to detachably secure the standard 28 to the tubular member 20. The upper end of the standard 28 is provided with a tubular sleeve 32 welded to the upper end of the standard 28 at 34 with the open upper end of the tubular sleeve 32 telescopically receiving an upper standard 36 which is inserted into the sleeve 32 and secured detachably therein by wing-type set screws 38. The upper arm assembly 16 includes a depending tubular member 40 which telescopes over the upper end of the standard 36 and is detachably secured thereto by wing-type set screws or bolts 42. A laterally extending tubular arm 44 is pivotally connected between upwardly extending tabs or lugs 46 by a pivot bolt 48. The upper ends of the tabs or lugs 46 extend above the pivot bolt 48 and include a laterally extending bracket 50 which engages one end of a coil spring 52 which engages the upper surface of the arm 44 in spaced relation to the pivot bolt 48 to bias the arm 44 downwardly toward the lower arm 24 with the spring 52 enabling limited upward pivotal movement of the arm 44 and biasing the arm 44 downwardly. The end of the arm 44 which extends beyond the pivot bolt 48 in opposite relation to the spring 52 forms an extension handle 54 by which the arm 44 can be pivoted or the arm 44 can be grasped anywhere along its length and moved upwardly against the bias of the coil spring 52.

The lower arm 24 terminates at its outer end in a transverse tubular member 56 with an upstanding pin 58 welded thereto in alignment with the center of the arm 24 with the pin 58 having a pointed upper end 60. The upper arm 44 includes a depending pin 62 rigidly affixed thereto with the lower end of the pin 62 including a pointed end 64. The pointed ends 60 and 64 of the pins 58 and 62 are in vertical alignment and engage a point on the top and bottom edges of the door 18 respectively as illustrated in FIG. 1. The spring 52 enables the upper arm 44 and pin 62 to be moved upwardly sufficient to enable the door to be first engaged with the upper pin 62 and lifted upwardly with the bottom edge of the door then being swung inwardly and engaged with the pointed end 60 of the lower pin 58 with the spring 52 biasing the upper pin 62 and the door downwardly thereby securely mounting the door in the fixture to enable the door to be rotated about a vertical axis that may be centered or off-center in relation to the door so that both sides of the door can be exposed to a painter handling a paint applying device such as a paint sprayer 74 without the painter walking around the door or lifting the door and rotating it 180° since the door 18 can be oriented with either side of the door facing the painter.

One end of the transversely extending member 56 is provided with a tubular member 66 perpendicular to the outer end of the tubular member 56 with the tubular member 66 having its center welded to the end of the member 56 and positioned in the same horizontal plane. Positioned above the tubular member 66 is an arcuately bowed rubber belt 68 having its ends adjustably received in tubular sleeve 70 welded on top of the tubular member 60 with wing-type set screws or bolts 72 being provided to adjustably clamp the ends of the arcuately bowed rubber belt in adjusted positioned thus varying the central height of the bowed belt 68 in order for the bowed belt 68 to frictionally engage the bottom edge of the door 18 in spaced relation to the pin 58 with the bowed belt providing sufficient resistance to rotational movement to retain the door in both of its 180° rotated positions while the door is being painted thereby enabling the painter to use both hands when operating the paint applying equipment and enabling the door to be quickly and easily rotated 180° to enable efficient painting of both surfaces of the door.

The knockdown structure of the stand enables the components thereof to be separated and stored or transported in a compact condition to enable it to be easily carried to a site of use. The fixture can be quickly and easily set up due to the telescopic connections and wing-type bolts securing the components in place. A door then can be quickly and easily positioned in the fixture by engaging the upper end edges of the door with the pin 62 with the upper pin being lifted upwardly along with the arm 44 about pivot bolt 48 by lifting the door upwardly with the spring 52 biasing the upper pin 62 and door 18 downwardly into engagement with the bottom pin 58. The door can then be painted completely on both sides and all edges. The size of the components may vary but the length of the arms 24 and 44 may be sufficient to support doors up to 48" in width which is usually the largest doors encountered. The transverse member 56 may be provided with end apertures to enable the stand to be temporaily anchored to a floor or other supporting surface. The door painting fixture enables a plurality of doors to be quickly and easily painted with the rotatable movement of the doors enabling all surfaces of the doors to be more uniformly and easily painted by using conventional spray equipment to apply various types of coating to the door such as lacquers, paints and the like.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A fixture for supporting an article having opposed large side surfaces interconnected by peripheral narrow opposed edges during coating thereof, said fixture comprising a pair of spaced, aligned members, said members having free ends disposed in facing opposed relation, and means on the free ends of said members to supportingly engage the central area of opposed edges of the article in a manner to enable the article to pivot about an axis to enable one side surface of the article to be coated and the article rotated 180° about the axis to enable the other side surface of the article to be coated without lifting the article or walking around the article, and means frictionally engaging only one of the narrow edges of the articles to releasably retain the article in one of its rotated positions.

2. The fixture as defined in claim 1 wherein said means frictionally engaging only one of the narrow edges of the article includes an upwardly bowed flexible member supported in a position to engage one of the narrow edges of the articles in spaced relation to the means on the free ends of said members to supportingly engage the central area of opposed edges of the article, and means adjustably connecting at least one end of the flexible member to vary the frictional engagement with one of the narrow edges of the article in its 180° rotated positions.

3. The fixture as defined in claim 1 wherein said members are in the form of opposed arms having inwardly extending pins disposed in opposed aligned relation with the pins having ends engaging opposed edges of the article and said fixture further comprises means interconnecting said arms with one of said arms being pivotal about an axis to enable the pin thereon to be moved toward and away from the edge of the article and spring means engaged with the pivotal arm to bias the pin on the pivotal arm into engagement with the article and to retain the article in assembled relation between the pins.

4. A fixture for supporting an article having opposed large side surfaces interconnected by peripheral narrow opposed edges during coating thereof, said fixture comprising a pair of spaced, aligned members, said members having free ends disposed in facing opposed relation, and means on the free ends of said members to supportingly engage the central area of opposed edges of the article in a manner to enable the article to pivot about an axis to enable one side surface of the article to be coated and the article rotated 180° about the axis to enable the other side surface of the article to be coated without lifting the article or walking around the article, and means frictionally engaging only one of the narrow edges of the article to releasably retain the article in one of its rotated positions, said members being pins with the means on the free ends thereof being pointed ends on the pins to engage the edges of the article, and means spring biasing one of said pins towards the edge of the article to securely mount the article for rotational movement, one of said pins being a lower pin mounted on a base having an arm on which said lower pin is provided, the other pin being an upper pin mounted on an upper pivotal arm in vertically spaced relation to the base, and a vertical stand supporting each of said arms and base in spaced, aligned and assembled relation, said means biasing one of said pins including a spring engaged with the upper arm to bias the upper arm and pin toward an upper edge of the article, said stand including a vertical standard extending between the base and the upper arm with the standard being constructed of separable components which are also separable from the base and upper arm to enable the components of the stand to be assembled and disassembled for ease of storage and transport to a site of use, an upper end portion of the standard being pivotally connected to the upper arm by a pivot bolt, the upper end of the standard extending above the pivot bolt and including a bracket supporting said spring engaged with the upper arm in spaced relation to the pivot bolt to bias an outer end of the upper arm downwardly for engaging the upper pin with the article and retaining the article in assembled relation between the pins.

5. The fixture as defined in claim 4 wherein said means frictionally engaging the edge of the article includes an upwardly bowed rubber belt supported from the base in spaced relation to the lower pin with the ends of the belt being connected to the base, and means adjustably connecting at least one end of the belt to the base to vary the height of the central upwardly bowed portion of the belt to vary the frictional engagement thereof with a bottom edge of the article to retain the article in its 180° rotated positions.

6. A fixture for supporting a relatively thin panel-like member when painting the exterior surfaces thereof, said fixture comprising an elongated support member, a pair of laterally extending, opposed, aligned arms mounted on said support member, pivot means connecting one of said arms to said support member to enable said one of said arms to pivot toward and away from the other of said arms, spring means interconnecting the support member and said one of said arms to bias said one of said arms toward the other of said arms, each of said arms including a projecting pointed member remote from the support member with the pointed members extending toward each other in opposed aligned relation and structured to engage opposite edges of said panel-like member to support the panel-like member from the arms to enable the panel-like member to rotate about an axis defined by the projecting pointed members to facilitate painting of all surfaces of said panel-like member without moving a paint applying device around the panel-like member by rotating the panel-like member about the axis of the pointed members, and means on one of said arms engaging an edge to said panel-like member in spaced relation to the rotational axis to frictionally retain the panel-like member in one rotated position to stabilize the panel-like member while applying paint thereto, said spring biased arm enabling insertion of and removal of the panel-like member from between the opposed pointed members, said support member being vertically disposed, said other of said arms extending horizontally from the lower end of the support member with the support member and said other arm including bottom surfaces oriented in the same plane for engaging a support surface, the end of said other arm remote from the support member including a transverse member attached thereto, said means engaging the edge of the panel-like member being mounted on said transverse member, said means engaging the edge of the panel-like member including an upwardly bowed, flexible, resilient member, means adjustably supporting at least one end of the upwardly bowed member from the transverse member to enable adjustment of the overall length of the flexible resilient member to vary the degree of upward bow in the flexible, resilient member in order to vary the frictional engagement between the edge of the panel-like member and the upwardly bowed resilient, flexible member.

7. The fixture as defined in claim 6 together with means detachably connecting said support member and arms, said support member being of sectional construction to enable the support member and arms to be knocked down to facilitate storage and transport of the fixture.

* * * * *